US009822568B2

(12) United States Patent
Matsushita

(10) Patent No.: US 9,822,568 B2
(45) Date of Patent: Nov. 21, 2017

(54) WINDOW REGULATOR CABLE GUIDE

(71) Applicant: HI-LEX CONTROLS INC., Rochester Hills, MI (US)

(72) Inventor: Masayuki Matsushita, Rochester Hills, MI (US)

(73) Assignee: HI-LEX CONTROLS INC., Rochester Hills, MI (US)

( * ) Notice: Subject to any disclaimer, the term of this patent is extended or adjusted under 35 U.S.C. 154(b) by 0 days.

(21) Appl. No.: 15/076,020

(22) Filed: Mar. 21, 2016

(65) Prior Publication Data

US 2017/0268273 A1 Sep. 21, 2017

(51) Int. Cl.

| | |
|---|---|
| ***E05F 11/48*** | (2006.01) |
| ***E05D 15/16*** | (2006.01) |
| ***E05F 15/689*** | (2015.01) |

(52) U.S. Cl.

CPC ..... *E05D 15/165* (2013.01); *E05F 15/689* (2015.01); *E05Y 2900/55* (2013.01)

(58) Field of Classification Search

CPC ..... E05D 15/165
USPC ..... 49/352
See application file for complete search history.

(56) References Cited

U.S. PATENT DOCUMENTS 4,433,508 A 2/1984 Carletta
4,663,886 A * 5/1987 Nakamura ..... B60J 1/17 49/352
4,888,916 A * 12/1989 Hess ..... E05F 11/483 49/352
5,613,322 A 3/1997 Kobrehel
5,617,675 A 4/1997 Kobrehel
5,864,987 A 2/1999 Mariel et al.
6,546,672 B2 4/2003 Tatsumi et al.
6,810,623 B2 * 11/2004 Messlez ..... B60J 1/17 49/352
7,617,633 B2 * 11/2009 Shimura ..... E05F 11/382 49/348
8,938,914 B2 1/2015 Hulst et al.
2004/0144032 A1 * 7/2004 Smith ..... E05F 11/486 49/352
2007/0180773 A1 * 8/2007 Fortin ..... E05F 11/485 49/352
2008/0005971 A1 1/2008 Dickie et al.
2011/0010999 A1 * 1/2011 Broadhead ..... B60J 5/0416 49/352

(Continued)

FOREIGN PATENT DOCUMENTS

CA 2 436 370 A1 7/2002
EP 2 589 737 A1 5/2013

(Continued)

*Primary Examiner* — Jerry Redman
(74) *Attorney, Agent, or Firm* — Brinks Gilson & Lione

(57) ABSTRACT

A cable guide for use with a window regulator assembly includes a body, an attachment configured to be inserted through an aperture in a guide rail and retain a portion of the guide rail in a rail gap, a spring tab configured to press against an edge of the guide rail, and a cable retention arm configured to receive a tensioned drive cable of the window regulator. The cable guide may be steadily assembled to the guide rail by utilizing the pushing force from the tensioned drive cable. The aperture is located along the guide rail such that the aperture is out of the slide path of the window carrier of the window regulator assembly.

20 Claims, 4 Drawing Sheets

(56) References Cited

U.S. PATENT DOCUMENTS

| | | | | |
|---|---|---|---|---|
| 2013/0227889 | A1* | 9/2013 | Matsushita ..... | E05F 11/483<br>49/352 |

FOREIGN PATENT DOCUMENTS

| | | | | |
|---|---|---|---|---|
| JP | 02272186 | A | * | 11/1990 |
| JP | H 10-203162 | | | 8/1998 |
| JP | 2009-299429 | A | | 12/2009 |
| KR | 100680740 | | | 2/2007 |
| WO | WO 2014/155774 | A1 | | 10/2014 |

* cited by examiner

WINDOW REGULATOR CABLE GUIDE

FIELD OF THE INVENTION

The invention relates to a cable guide for use with an automotive window regulator assembly.

BACKGROUND

Passenger car motor vehicles have for many decades featured movable side door glass. A mechanism is required in order to move the glass between the upper closed position and the lower opened position. These mechanisms are generally known as window regulators. Window regulators can be manually operated, or can be driven by a powered actuator, most commonly using an electric motor. One type of window regulator uses a pulley arrangement having a metal cable wrapped around pulleys and a drum driven by an electric motor. Such devices typically use a carrier which engages the door glass. The carrier may be driven along a metal guide rail by the metal cable. Specifically, the electric motor drives the drum, thereby moving the cable about the pulley arrangement and driving the carrier to control the vertical motion of the window glass.

Due to the packaging constrains of some vehicle door panels and other design constraints the electric motor and cable drum of a window regulator assembly may be located near the bottom of the guide rail. In such assemblies, the metal cable spans the length of the guide rail unsupported. To support and guide the metal cable spanning the length of the guide rail, some window regulator assemblies include a cable guide that may be attached to the guide rail. The cable guide is primarily provided to avoid undesirable noise resulting from vibration of the unsupported cable and to adjust the location of the cable to provide clearance with other door components. Conventional cable guides are typically attached to the guide rail at approximately its center using welding or TOX (interlocking metal deformation) joining. Such cable guides also require a bracket be placed between the guide rail and the cable guide.

Despite the satisfactory performance of conventional cable guides, there is constantly a desire to reduced cost, increase ease of assembly, and reduce the weight of automotive components, while providing a desirable durability, low warranty claims, and compliance with performance requirements.

SUMMARY

The present disclosure relates to a cable guide for use with an automotive window regulator assembly which addresses the above-referenced desirable attributes. According to one form of the present disclosure, the cable guide includes a body having a guide rail region near a first end of the body and a cable region near a second end of the body. The guide rail region has a rail support surface and the cable region has a cable support surface. The guide rail region and cable region define a recessed region of the body between the first end and the second end of the body. The recessed region has a surface recessed from the rail support surface and the cable support surface. The cable guide further includes an attachment arm with a first portion and a second portion. The first portion of the attachment arm extends from the rail support surface. The second portion of the attachment arm is cantilevered from the first portion such that at least an end of the second portion extends beyond the guide rail region and above the recessed region of the body. The second portion of the attachment arm and the rail support surface define a rail gap. The cable guide further includes a spring tab that extends from the recessed surface. An end of the spring tab extends beyond the rail support surface. The cable guide further includes a cable retention arm having a first portion and a second portion. The first portion of the cable retention arm extends from the cable support surface. The second portion of the cable retention arm is cantilevered from the first portion such that an end of the second portion extends toward the second end of the body, and wherein the second portion of the cable retention arm and the cable support surface define a cable gap.

Further aspects of the invention are explained in greater detail below by means of preferred illustrative embodiment with reference to the attached drawings. The drawings are provided for purely illustrative purposes and are not intended to limit the scope of the present invention.

BRIEF DESCRIPTION OF THE DRAWINGS

Further details of the invention are described in more detail with reference to the drawings, in which.

DETAILED DESCRIPTION

Figure 1:
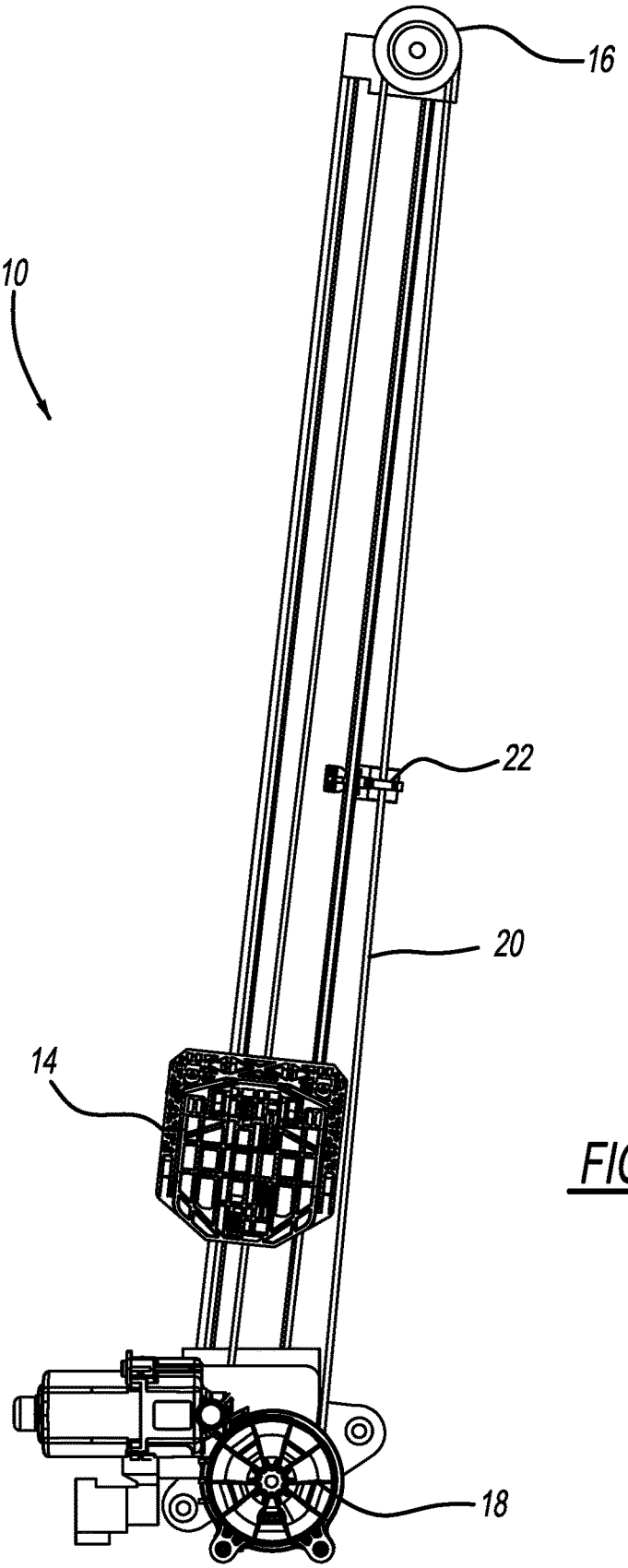
FIG. 1 is a perspective view of a window regulator assembly incorporating a cable guide in accordance with the present disclosure.

With reference to FIG. 1, a window regulator assembly 10 is illustrated, which includes as principal components, a guide rail 12, a window carrier 14, a pulley assembly 16, a motor drive assembly 18, a drive cable 20, and a cable guide 22. The guide rail 12 may be formed of sheet-metal using a forming or rolling process or as an extrusion. The window carrier 14 is caused to travel up and down along the guide rail 12 and includes a window clamp arrangement (not illustrated) which attaches to the lower edge of the vehicle side door glass (not illustrated).

The pulley assembly 16 is positioned at the top of the guide rail 12 and acts to redirect and tension the drive cable 20. The motor drive assembly 18 positioned at the bottom of the guide rail 12 is actuated and powered electrically to move the drive cable 20. The drive cable 20 wraps around the pulley assembly 16 and wraps around a pulley within the motor drive assembly 18 where it is driven. Ends of the drive cable 20 may terminate at attachment points on the window carrier 14. The drive cable 20 spans the entire length of the guide rail 12. A cable guide 22 in accordance with the present invention is attached to the guide rail 12 to support the drive cable 20 to reduce noise and rattle caused by vibration of the drive cable 20. The motor drive assembly 18 is affixed to the bottom of the guide rail 12 but could be positioned at other locations depending on application requirements. Similarly the pulley assembly 16 is shown at the top of the guide rail 12 but may be implemented in various other positions depending on the application. The cable guide 22 is attached to the guide rail 12 at a position along the length of the guide rail 12 between the motor drive assembly 18 and the pulley assembly 16. The window regulator assembly 10 is shown as a single rail type system. Alternate implementations may use a pair of separated guide rails provided for better control of the movable glass or other panel.

Figure 2A:
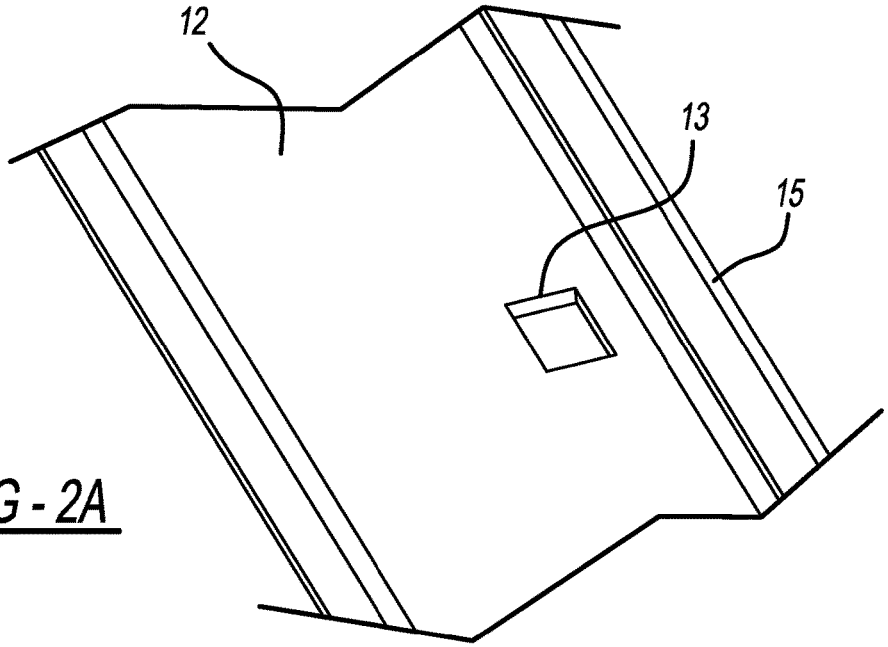
FIGS. 2A and 2B show an enlarged view of the guide rail and of the cable guide of the present disclosure attached to a guide rail of the window regulator assembly of FIG. 1.
Figure 2B:
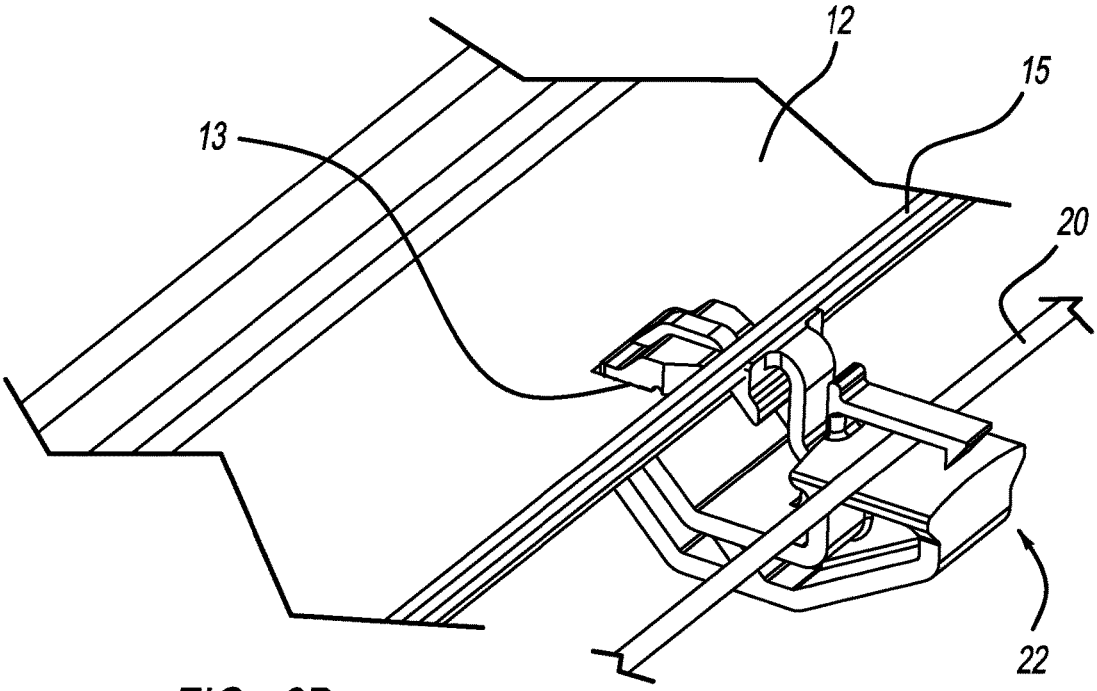

FIG. 2A shows a section of the guide rail 12 of the window regulator assembly 10. An aperture 13 passes through the guide rail 12 near an edge 15 of the guide rail 12. The aperture 13 is located in an area of the guide rail 12 where the window carrier 14 does not slide on the guide rail 12 as the window carrier 14 moves the window glass between the open and closed positions. Locating the aperture 13 in such a position allows the use of a simple through hole for the aperture 13 rather than requiring a specially manufactured depression or depression and hole combination as is required by standard cable guides. Therefore, by locating the aperture 13 near the edge 15 of the guide rail 12 out of the path 17 of the window carrier 14, the ease of guide rail 12 design and manufacturing is improved. The aperture 13 is located along the length of the guide rail 12 between the pulley assembly 16 at one end of the guide rail 12 and the motor drive assembly 18 at another end of the guide rail 12. FIG. 2B shows the same section of the guide rail 12 as shown in FIG. 2A with the cable guide 22 connected to the guide rail 12. The cable guide 22 attaches to the guide rail 12 at the aperture 13. When attached to the guide rail 12, the cable guide 22 retains and supports the drive cable 20 of the window regulator assembly 10.

Figure 3A:
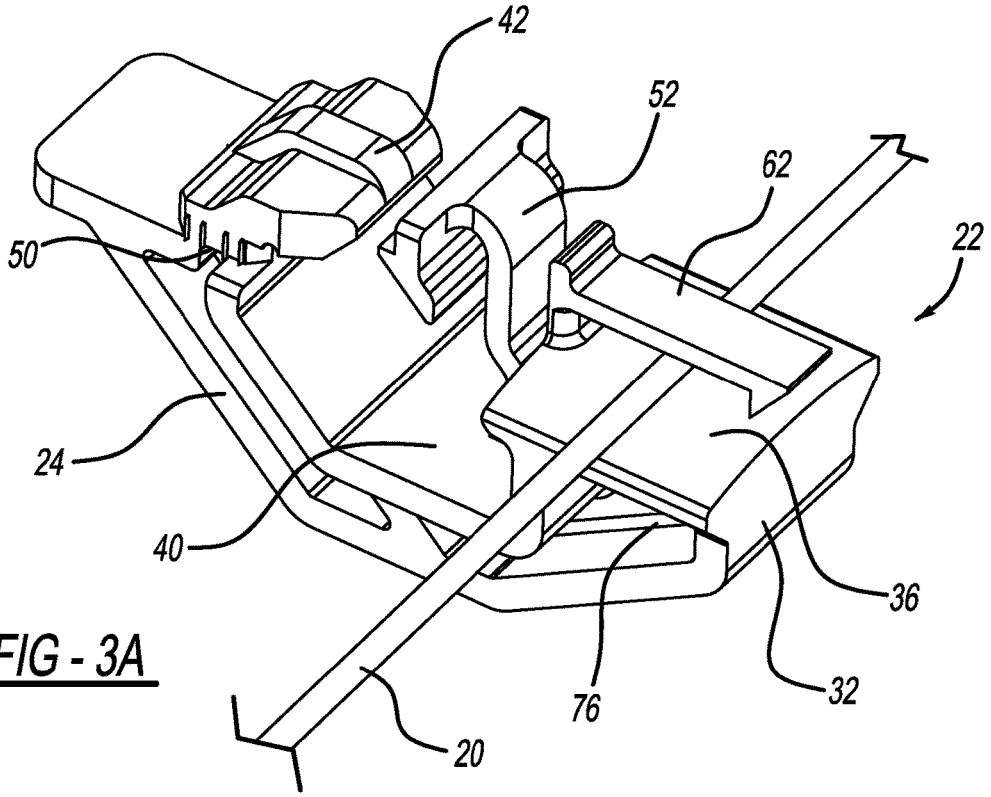
FIGS. 3A and 3B are perspective views of the cable guide in accordance with the present disclosure.
Figure 3B:
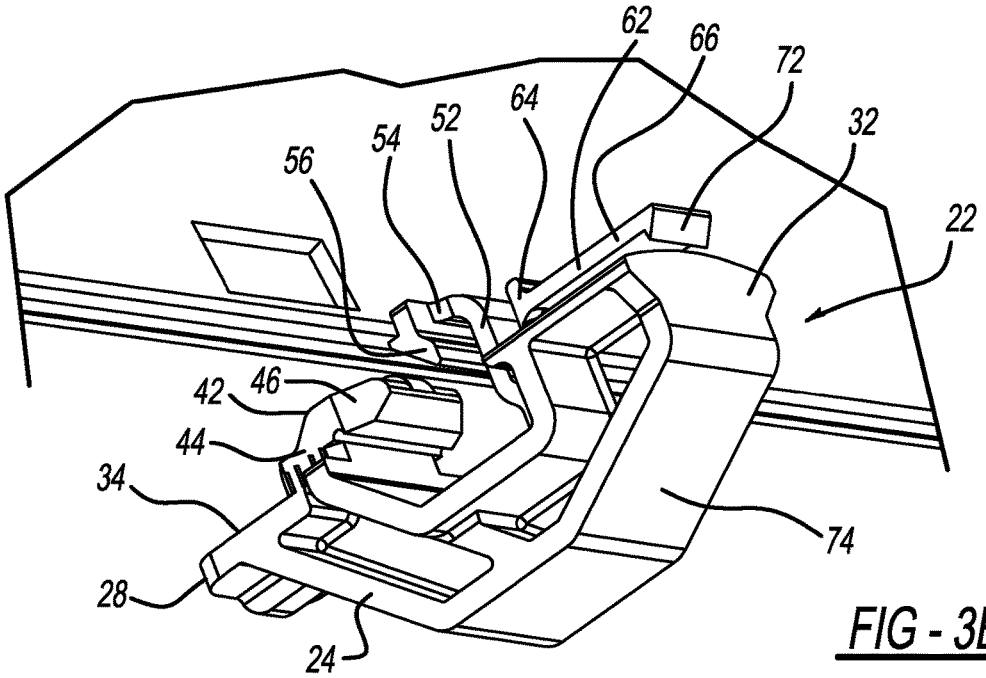
Figure 4:
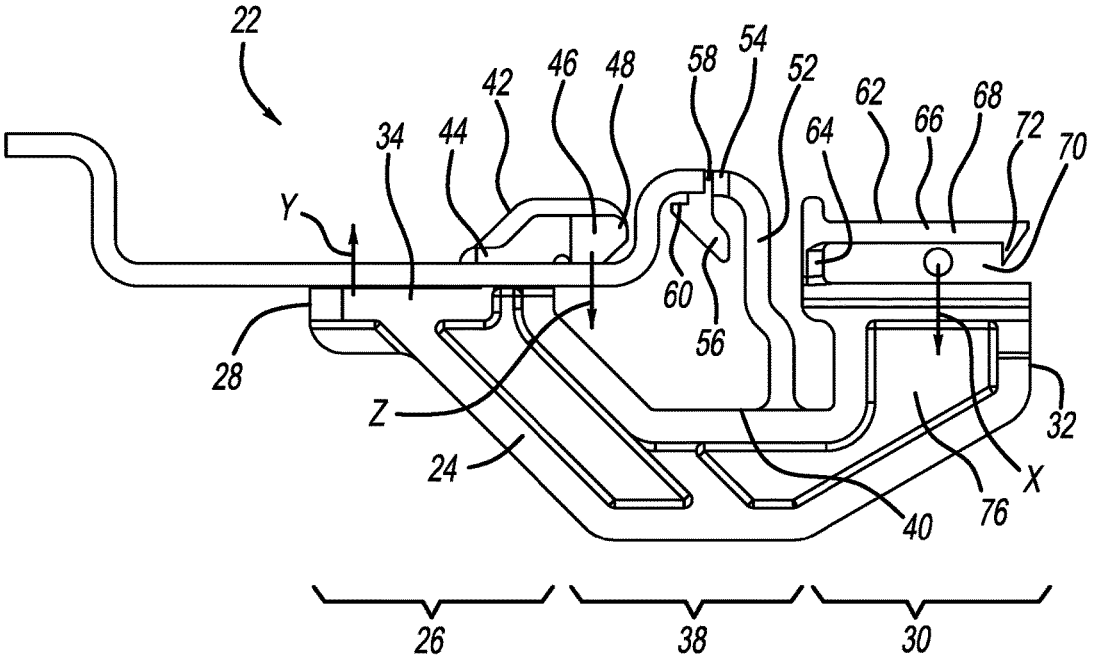
FIG. 4 is a side view of the cable guide in accordance with the present disclosure attached to a guide rail of a window regulator.

Referring to FIGS. 3A, 3B and 4, the cable guide 22 includes a body 24 that has a guide rail region 26 near a first end 28 of the body 24 and a cable region 30 near a second end 32 of the body 24. The guide rail region 26 has a rail support surface 34. The cable region 30 has a cable support surface 36. The rail support surface 34 and the cable support surface 36 are substantially coplanar. The guide rail region 26 and cable region 30 define a recessed region 38 of the body 24. The recessed region 38 is positioned between the first end 28 and the second end 32 of the body 22. The recessed region 38 has a surface recessed 40 from the rail support surface 34 and the cable support surface 36. The rail support surface 34, recessed surface 40, and the cable support surface 36 are positioned along what may be considered the top of the body 22, however, the terms top, bottom, side, etc. are simply used in this description to facilitate ease of understanding and are in no way intended to limit the scope of the disclosure. The cable guide 22 also includes a bottom surface 74.

The cable guide 22 further includes an attachment arm 42. As shown, the attachment arm 42 is L-shaped with a first portion 44 and a second portion 46. The attachment arm 42 is integrally formed with the body 24. The first portion 44 and the second portion 46 are integrally formed. The second portion 48 of the attachment arm 42 is configured to be placed through an aperture 13 in a guide rail 12. The area where the first portion 44 and second portion 46 come together or where the first portion 44 transitions to the second portion 46 may be curved, tapered, or angled to facilitate the installation of the cable guide 22 to the guide rail 12. The first portion 44 of the attachment arm 42 extends from the rail support surface 34. As shown, the first portion 44 is perpendicular to the rail support surface 34, however, other suitable angled may be implemented. The second portion 46 of the attachment arm 42 is cantilevered from the first portion 44 such that at least an end 48 of the second portion 46 extends beyond the guide rail region 26 and above the recessed region 38 of the body 24. The end 48 of the second portion 46 of the attachment arm 42 may be curved, blunt, or another geometry to correspond to the geometry of the guide rail 12.

The second portion 46 of the attachment arm 42 and the rail support surface 34 define a rail gap 50. The thickness of the rail gap 50 corresponds to the thickness of the guide rail 12 such that when the guide rail 12 is positioned in the rail gap 50, the second portion 46 of the attachment arm 42 and the rail support surface 34 are in contact with the guide rail 12. The guide rail 12 and the rail gap 50 fit tightly together.

The cable guide 22 further includes a spring tab 52. The spring tab 52 extends from the recessed surface 40 such that an end 54 of the spring tab 52 extends beyond the rail support surface 34. The spring tab 52 is configured to push against an edge 15 of the guide rail 12 when the cable guide 22 is attached to the guide rail 12. The end of the spring tab 52 may form a stopper 56. As shown, the stopper 56 has a stopper wall 58 and a stopper lip 60 perpendicular to the stopper wall 58. In an embodiment including a stopper 56, the stopper wall 58 presses against an edge 15 of the guide rail 12 and the a portion of the guide rail 12 rests upon or abuts the stopper lip 60 such that the stopper lip 60 helps to maintain the alignment of the stopper wall 58 and the edge 15 of the guide rail 12. The spring tab 52 is integrally formed with the body 24 of the cable guide 22. As shown, the spring tab 52 is J-shaped and is perpendicular to the recessed surface 40.

The cable guide 22 further includes a cable retention arm 62. The cable retention arm 62 is L-shaped and has a first portion 64 and a second portion 66. The cable retention arm 62 is integrally formed with the body 24. The first portion 64 and the second portion 66 are integrally formed. The area where the first portion 64 and second portion 66 come together or where the first portion 64 transitions to the second portion 66 may be curved, tapered, or angled. The first portion 64 of the cable retention arm 62 extends from the cable support surface 36. The first portion 64 is perpendicular to the cable support surface 36. The second portion 66 of the cable retention arm 62 is cantilevered from the first portion 64 such that an end 68 of the second portion 66 extends toward the second end 32 of the body 24.

The second portion 66 of the cable retention arm 62 and the cable support surface 36 define a cable gap 70. The cable retention arm 62 is configured to receive a drive cable 20 of a window regulator 10 in the cable gap 70. The thickness of the cable gap 70 is equal to or greater than the thickness or diameter of the drive cable 20 such that the drive cable 20 fits in the cable gap 70. The end 68 of the second portion 66 of the retention arm 62 may form a cable lock 72 to retain the drive cable 20 in the cable gap 70. As shown, the cable lock 72 is a triangle integrally formed with the end 68 of the second portion 66. They hypotenuse of the triangle is positioned near the second end 32 of the body 22 to allow the drive cable 20 to be inserted into the cable gap 70 with ease. A leg of the triangular shaped cable lock 72 borders the cable gap 70 and acts as a wall to keep the drive cable 20 retained within the cable gap 70.

The cable guide 22 is attached to the guide rail 12 of the window regulator assembly 10 by first inserting the edge 15 of the guide rail 12 near the aperture into the area above the recessed portion 38 of the cable guide 22 such that the edge 15 of the guide rail is between the second portion 46 of the attachment arm 42 and the spring tab 52. Maintaining that relative position of the edge 15 of the guide rail 12 between the attachment arm 42 and the spring tab 52, the cable guide 22 is rotated about the guide rail 12 such that the end 48 of the second portion 46 of the attachment arm 42 is inserted into the aperture 15 of the guide rail 12. Continuing to rotate the cable guide 22 about the guide rail 22 causes a portion of the guide rail 12 to move into the rail gap 50 defined by the attachment arm 42 and the rail support surface 34. The rest of the rail support surface 34 proximate the first end 28 of the body 24 comes in contact with the guide rail 12. The spring tab 52 is positioned close to the edge 15 of the guide rail 12 such that the spring tab 52 presses against the edge 15 of the guide rail 12 to secure the cable guide 22 to the guide rail 12. In an embodiment including a stopper 56 on the end 54 of the spring tab 52, the stopper wall 58 presses against an edge 15 of the guide rail 12 and the a portion of the guide rail 12 rests upon or abuts the stopper lip 60 such that the stopper lip 60 helps to maintain the alignment of the stopper wall 58 and the edge 15 of the guide rail 12. The force exerted by the spring tab 52 on the edge 15 of the guide rail 12 reduces looseness which can cause rattle and noise. The drive cable 20 is inserted into the cable gap 70 between the cable retention arm 62 and the cable support surface 36. In an embodiment including a cable lock 72, the cable lock 72 retains the drive cable 20 in the cable gap 70.

As shown in FIG. 4, the tensioned drive cable 20 exerts a force X on the cable support surface 36. The rail support surface 34 in turn exerts a force Y on the guide rail 12 near the center of the guide rail 12. The second portion 46 of the attachment arm 42 also exerts a force Z on the guide rail 12. These forces are balanced to steadily secure the cable guide 22 to the guide rail 12 of the window regulator assembly 10.

As shown in FIG. 3B, the cable region 30 of the body 24 contains a hole 76 defined by the body 24. The hole 76 may extend either partially or entirely through the body 24 of the cable guide 22. The hole 76 may be included to assist with manufacturing the cable guide 22 and reduce the overall weight of the cable guide 22.

The cable guide 22 may be formed of a plastic material using an injection molding process or any other suitable manufacturing process.

While the above description constitutes the preferred embodiments of the present invention, it will be appreciated that the invention is susceptible to modification, variation and change without departing from the proper scope and fair meaning of the accompanying claims.

What is claimed is:

1. A cable guide for use with a window regulator, the cable guide comprising:

a body having a guide rail region near a first end and a cable region near a second end, the guide rail region having a rail support surface, the cable region having a cable support surface, and the guide rail region and cable region defining a recessed region of the body between the first end and the second end, the recessed region having a surface recessed from the rail support surface and the cable support surface;

an attachment arm configured to be steadily secured to a fixed location on a guide rail of the window regulator, the attachment arm having a first portion extending from the rail support surface, and a second portion cantilevered from the first portion such that at least an end of the second portion extends beyond the guide rail region and above the recessed region of the body, and wherein the second portion and the rail support surface define a rail gap;

a spring tab extending from the recessed surface such that an end of the spring tab extends beyond the rail support surface; and a cable retention arm having a first portion extending from the cable support surface and a second portion cantilevered from the first portion such that an end of the second portion extends toward the second end of the body, and wherein the second portion of the cable retention arm and the cable support surface define a cable gap.

2. The cable guide of claim 1, wherein the second portion of the attachment arm is configured to be placed through an aperture in the guide rail and retain a portion of the guide rail in the rail gap defined between the attachment arm and the rail support surface.

3. The cable guide of claim 2, wherein the aperture is located along the guide rail between a window regulator motor at a first end of the guide rail and a window regulator pulley at a second end of the guide rail.

4. The cable guide of claim 1, wherein the spring tab is configured to press against an edge of the guide rail.

5. The cable guide of claim 4, wherein the end of the spring tab forms a stopper having a stopper wall and a stopper lip perpendicular to the stopper wall, and wherein the stopper wall is configured to press against the edge of the guide rail and the stopper lip is configured to abut the guide rail and maintain alignment of the stopper wall and the edge of the guide rail.

6. The cable guide of claim 1, wherein the cable retention arm is configured to receive a window regulator cable in the cable gap defined between the cable retention arm and the cable support surface.

7. The cable guide of claim 6, wherein the end of the cable retention arm forms a cable lock to retain the window regulator cable in the cable gap.

8. The cable guide of claim 1, wherein the rail support surface and the cable support surface are substantially coplanar.

9. The cable guide of claim 1, wherein the attachment arm is integrally formed with the body.

10. The cable guide of claim 1, wherein the spring tab is integrally formed with the body.

11. The cable guide of claim 1, wherein the cable retention arm is integrally formed with the body.

12. The cable guide of claim 1, the cable region of the body contains a hole defined by the body.

13. The cable guide of claim 1, wherein the cable guide is formed of a plastic material using an injection molding process.

14. A cable guide for use with a window regulator, the cable guide comprising:

a body having a rail support surface near a first end of the body and a cable support surface near a second end of the body spaced apart from the rail support surface;

an attachment arm configured to be steadily secured to a fixed location of a guide rail of the window regulator, the attachment arm having a first portion extending from the rail support surface, and a second portion cantilevered from the first portion such that an end of the second portion extends toward the cable support surface, and wherein the second portion and the rail support surface define a rail gap;

a spring tab extending from a surface between the rail support surface and the cable support surface such that an end of the spring tab extends beyond the rail support surface;

a cable retention arm having a first portion extending from the cable support surface and a second portion cantilevered from the first portion, and wherein the second portion of the cable retention arm and the cable support surface define a cable gap; and wherein, the cable guide is configured to interlock with a window regulator guide rail.

15. The cable guide of claim 14, wherein the second portion of the attachment arm is configured to be placed through an aperture in the guide rail and retain a portion of the guide rail in the rail gap defined between the attachment arm and the rail support surface.

16. The cable guide of claim 15, wherein the aperture is located along the guide rail between a window regulator motor at a first end of the guide rail and a window regulator pulley at a second end of the guide rail.

17. The cable guide of claim 14, wherein the end of the spring tab is configured to press against an edge of the guide rail to stabilize the cable guide on the guide rail.

18. The cable guide of claim 14, wherein the cable retention arm is configured to receive a window regulator cable in the cable gap defined between the cable retention arm and the cable support surface.

19. The cable guide of claim 18, wherein an end of the cable retention arm forms a cable lock to retain the window regulator cable in the cable gap.

20. The cable guide of claim 14, wherein the cable guide is formed of a plastic material using an injection molding process.

* * * * *